US007520206B2

(12) United States Patent
Baker

(10) Patent No.: US 7,520,206 B2
(45) Date of Patent: Apr. 21, 2009

(54) BALLISTIC SHIELD AND METHODS OF USE

(76) Inventor: Alfred J. Baker, 131 Jackson Crescent, Centerport, NY (US) 11721

( * ) Notice: Subject to any disclaimer, the term of this patent is extended or adjusted under 35 U.S.C. 154(b) by 484 days.

(21) Appl. No.: 11/118,328

(22) Filed: May 2, 2005

(65) Prior Publication Data

US 2005/0217472 A1 Oct. 6, 2005

Related U.S. Application Data

(60) Continuation-in-part of application No. 10/609,409, filed on Jul. 1, 2003, now Pat. No. 6,886,446, which is a division of application No. 10/013,549, filed on Dec. 13, 2001, now Pat. No. 6,595,101.

(51) Int. Cl.
*F41H 5/12* (2006.01)

(52) U.S. Cl. ..... 89/36.06; 89/36.05; 89/36.07

(58) Field of Classification Search ..... 89/36.05, 89/36.06, 36.07; 2/2.5
See application file for complete search history.

(56) References Cited

U.S. PATENT DOCUMENTS

| | | | | |
|---|---|---|---|---|
| 1,166,557 | A | 1/1916 | Stergianopulos | |
| 1,273,371 | A | 7/1918 | Hudziak | |
| 1,274,757 | A | 8/1918 | Orenbuch | |
| 1,279,571 | A | 9/1918 | Moloney | |
| 2,020,702 | A | 11/1935 | Russell | |
| 2,215,204 | A | 9/1940 | Young | |
| 2,316,055 | A * | 4/1943 | Davey | 89/36.05 |
| 3,370,302 | A * | 2/1968 | Karlyn | 2/2.5 |
| 3,476,107 | A * | 11/1969 | Matt, Jr. et al. | 128/869 |
| 3,745,938 | A | 7/1973 | Hathaway et al. | |
| 4,412,495 | A * | 11/1983 | Sankar | 109/49.5 |
| 4,674,394 | A | 6/1987 | Martino | |
| 4,782,735 | A * | 11/1988 | Mui et al. | 89/36.07 |
| 4,843,947 | A * | 7/1989 | Bauer et al. | 89/36.05 |
| 5,241,703 | A | 9/1993 | Roberts et al. | |
| 5,293,807 | A | 3/1994 | Hajdu | |
| 5,392,686 | A | 2/1995 | Sanker | |
| 5,641,934 | A | 6/1997 | Follett | |
| 5,797,140 | A | 8/1998 | Davis et al. | |
| 6,131,524 | A * | 10/2000 | Nepper, Sr. | 109/49.5 |
| 6,389,949 | B1 | 5/2002 | Carreira | |
| 6,691,601 | B2 | 2/2004 | Cohen et al. | |
| 2002/0092416 | A1 * | 7/2002 | Cohen et al. | 89/36.05 |

FOREIGN PATENT DOCUMENTS

| | | |
|---|---|---|
| GB | 124353 | 3/1919 |

OTHER PUBLICATIONS

"Patroller," Protech Armored Products brochure, p. 4.
"Intruder," Protech Armored Products brochure, p. 3.

* cited by examiner

*Primary Examiner*—Troy Chambers
(74) *Attorney, Agent, or Firm*—Nixon & Vanderhye, P.C.

(57) ABSTRACT

An integral ballistic shield formed of ballistic material is provided with a central portion and side portions to provide front and partial side ballistic protection. A support extends from the backside of the shield adjacent a truncated V-groove opening through the upper edge of the shield. The support includes a handle for simultaneously grasping the grip of a long gun with one hand, enabling the individual to support the shield and the long gun by the one hand. The individual's opposite hand is free to operate the long gun. Thus, the hand that supports the shield also supports the long gun.

20 Claims, 9 Drawing Sheets

BALLISTIC SHIELD AND METHODS OF USE

This application is a continuation-in-part of application Ser. No. 10/609,409 filed Jul. 1, 2003 now U.S. Pat. No. 6,886,446 as a division of application Ser. No. 10/013,549 filed Dec. 13, 2001, now U.S. Pat. No. 6,595,101 issued Jul. 22, 2003.

BACKGROUND OF THE INVENTION

The present invention relates to a ballistic shield for use by police, military and the like to afford protection against ballistic threats, e.g., firearms and particularly relates to a ballistic shield designed specifically to enable a single individual to simultaneously deploy a ballistic shield with one hand and efficiently operate a long gun during such deployment using two hands.

Ballistic shields are oftentimes used by police, military and the like to afford protection against ballistic threats such as firearms. A ballistic shield is typically deployed by an individual while advancing toward or into an area of a threat. Conventional ballistic shields are typically part of equipment used by police in high-risk operations, for example, high-risk entries into buildings, apartments or the like, such as, during drug operations, warrant service or the like. The typical ballistic shield is designed to provide frontal protection to the operator, i.e., the individual holding the shield, from about the mid-thigh to the top of the head.

A conventional ballistic shield is generally formed of bulletproof material and usually includes a viewport in an upper portion of the shield such that the operator can view the threat or the area into which the individual is advancing through the viewport. The viewport, however, limits the operator's range of vision and oftentimes the operator cannot see low objects, for example, when advancing in a room. Further, the inside surface of the shield normally has a handle such that the operator carries the shield with the forearm in a generally vertical position. Because the viewport is formed of a heavy polycarbonate or lexan material, the shield is quite heavy. For example, a conventional shield typically weighs about sixteen pounds. As will be appreciated, one hand of the operator is dedicated to holding the shield while the operator's other hand remains free to operate the individual's firearm, i.e., a handgun. Thus, carrying a heavy shield in one hand and manipulating a handgun in the other hand requires substantial strength and dexterity and oftentimes diminishes the individual's capacity to operate the handgun effectively.

When advancing toward a threat, it will be appreciated that the operator must carry the heavy ballistic shield in a manner to afford frontal protection while at the same time be able to manipulate and operate a handgun around one side of the shield. Several disadvantages when using a handgun in this manner are readily apparent. First, by its nature the handgun is not an accurate weapon. By attempting to fire the handgun around the side of the ballistic shield while holding the shield and viewing the threat through the viewport, there is an inherent further decline in accuracy. Moreover, the handgun is not stable when held to one side of the shield, has substantial recoil which further diminishes its accuracy and can fire only a limited number of rounds. Ideally, a long gun would be preferable for use with a shield. However, operation of a long gun requires use of two hands; hence, an individual has not heretofore been able to hold a shield with one hand to afford frontal ballistic protection while simultaneously operating a long gun with two hands.

In typical high-risk entries where a long gun is desired, conventional tactics deploy an operator carrying a conventional ballistic shield as the lead or number one individual in a line or stack of individuals behind the shield and lead individual. The second, or number two individual, may carry a long gun. The protection afforded by the ballistic shield, however, must extend to the second and other individuals behind the individual carrying the shield. Typically, therefore, the individuals in the stack advance with and very closely behind the number one individual. If the number two individual operates a long gun, that individual must deploy the long gun around the side of the number one individual and the shield. This exposes the number two individual to the threat. Accordingly, there is a need to provide a ballistic shield which enables the operator to gain ballistic protection by deploying a ballistic shield in one hand and simultaneously enabling that same operator to efficiently operate the long gun with two hands.

SUMMARY OF THE PRESENT INVENTION

In accordance with a preferred embodiment of the invention, there is provided a ballistic shield affording ballistic protection to the torso of an individual carrying the shield while simultaneously enabling that individual to efficiently operate a long gun using two hands while holding the shield in one hand. As used herein, the term "long gun" means any rifle, submachine gun or any other weapons system requiring operation or efficient operation using two hands. To accomplish the foregoing, there is provided a ballistic shield, preferably formed of a pressed polyethylene, which affords frontal protection to the torso of an individual holding the shield and which provides a combination long gun support and shield support handle such that the individual can support the shield and the long gun with a single hand while operating the long gun using both hands. The ballistic shield includes a generally V-groove, preferably a notch, along the top margin of the shield adjacent to which a long gun/shield/support/handle is disposed along the inside surface of the shield. To use the shield, the support/handle is located and configured relative to the shield for grasping by one hand to hold the shield in front of the operator to afford full torso frontal protection while the same hand is positioned to simultaneously grip and support the forward end of the barrel or grip of the long gun. By this location and configuration of the support/handle, the long gun may be extended over the V-groove or notch of the shield with the stock of the long gun butting the individual's shoulder. The individual's other hand, of course, is free to operate the long gun.

A further feature of the present invention resides in the provision of a strap secured at one end to an inside surface of the shield at variable adjustable locations above the shield's center of gravity. In use, the opposite end of the strap is grasped by the individual's one hand, or looped about the individual's wrist. The strap may be used as part of the operator's support for the shield, but is primarily useful to reload or otherwise operate the long gun. To reload, the individual's hand grip about the support/handle and long gun is released and the shield is supported by the individual's hand or wrist holding the strap, at all times maintaining frontal ballistic protection. That same hand can then be used to change magazines on the long gun while the other hand supports the long gun with partial support of the long gun being provided by the support/handle. The operator may also opt to drop the long gun to a sling mode and then transition to a pistol which may be deployed in the same fashion as the long gun.

In another aspect of the present invention, the shield, which may be formed integral, is preferably formed in three discrete parts, i.e., a central section and two wings. The wings and central section are formed of ballistic material and the inside margins of the wings underlie the outer margins of the central section thus affording and maintaining full frontal ballistic protection. Elastic bands are spaced from one another along the outside and inside of the shield and along its vertical extent to secure the central portion and the wings to one another. By using adjustable elastic bands, the lateral extent or configuration of the shield can be changed, rendering the shield selectively wider or narrower. For example, when traversing hallways or narrow aisles, it may be desirable to adjust the lateral extent of the shield to provide a narrow shield such that the shield can be maintained in front of the operator. In more open areas, the shield can be adjusted to provide a wider shield, i.e., afford greater frontal protection for the individual's torso.

Further, each of the wings is formed in a compound curve, i.e., a convex/concave surface, in a lateral direction. This shape enhances the ability of the shield to stop a bullet. That is, the compound curve enables a greater area of the surface of the shield for direct frontal exposure. This enables the shield to meet a bullet at 90° rather than at an angle which would otherwise permit a ricochet. Further, the outer side edges of the shield are in a generally scalloped configuration. This affords additional protection for the upper body and thigh area of the individual's torso while reducing the weight of the shield and without substantial reduction of ballistic protection in the individual's mid-body region.

It will be appreciated that the long gun is located in a firing position over the upper margin, i.e., in the V-shaped groove or notch of the shield. In that condition, the individual's head is in a more exposed position when facing the threat. To afford ballistic protection to the individual's head and in one embodiment hereof, a ballistic helmet with a transparent ballistic visor is provided. The visor has a concave curve along at least one side and lower margin to facilitate the handling of the long gun in the area close to the individual's hand. That is, the curved lower margin of the visor enables the individual to sight the long gun without interference between the visor of the helmet and the long gun. To complete the ballistic protection, the lower portion of the individual's body also has shin and knee guards formed of a ballistic material.

In a preferred embodiment according to the present invention, there is provided ballistic protection apparatus comprising a ballistic shield having a body formed at least in part of ballistic material; the shield body configured to provide frontal ballistic protection at least in part to the torso of an individual when the shield is located in front of the individual; the shield body having a support on one side thereof for mounting a long gun and configured to enable an individual to simultaneously grasp the long gun and the support by one hand with a barrel of the long gun projecting from the shield body to an opposite side of the shield from the individual and to simultaneously effectively operate the long gun using both hands; the shield body including a central portion and a pair of side portions on respective opposite sides of the central portion to maintain ballistic protection both frontally and in part from the sides; and the support including a handle spaced from and extending generally vertically and parallel to the central portion of the shield body.

In a further preferred embodiment according to the present invention, there is provided ballistic protection apparatus comprising a ballistic shield having a body formed at least in part of ballistic material capable of stopping a bullet; the shield body configured to provide frontal ballistic protection at least in part to the torso of an individual when the shield is located in front of the individual; the shield body having a support for mounting a long gun and configured to enable an individual to simultaneously grasp the long gun and the support by one hand with a barrel of the long gun projecting forwardly from the shield body and to simultaneously effectively operate the long gun using both hands; the shield body including a central portion and a pair of side portions on respective opposite sides of the central portion to maintain ballistic protection both frontally and in part from the sides; the shield body including an opening therethrough above the location of the support, the opening being defined in part by lateral margins of the side portions diverging from one another in a general upward direction; and the support including a handle extending generally vertically and parallel to the central portion of the shield body of the shield body enabling the individual to simultaneously grasp the handle and grip of the long gun.

In a further preferred embodiment according to the present invention, there is provided ballistic protection apparatus comprising a ballistic shield having a body formed at least in part of ballistic material; the shield body including a central portion and a pair of side portions on respective opposite sides of the central portion to provide ballistic protection both frontally and in part from the sides to the torso of an individual when the shield is located in front of the individual; the shield body having a support on one side thereof for mounting a long gun and configured to enable an individual to simultaneously grasp the long gun and the support by one hand with a barrel of the long gun projecting from the shield body to an opposite side of the shield from the individual and to simultaneously effectively operate the long gun using both hands; and the support including a handle spaced from the central portion of the shield body.

In a further preferred embodiment according to the present invention, there is provided a method of deploying ballistic protection and long gun capability comprising the steps of providing a ballistic shield having a body formed at least in part of ballistic material and including a central portion and a pair of side portions on respective opposite sides of the central portion to afford ballistic protection both frontally and in part from the sides to the torso of an individual when the shield is located in front of the individual; providing a support on one side of the shield body for mounting a long gun; and simultaneously grasping the long gun and the support by one hand on the one side of the shield body with a barrel of the long gun projecting from an opposite side of the shield from the individual enabling the individual to support the shield with the one hand and simultaneously operate the long gun using both hands.

DETAILED DESCRIPTION OF THE INVENTION

Figure 1:
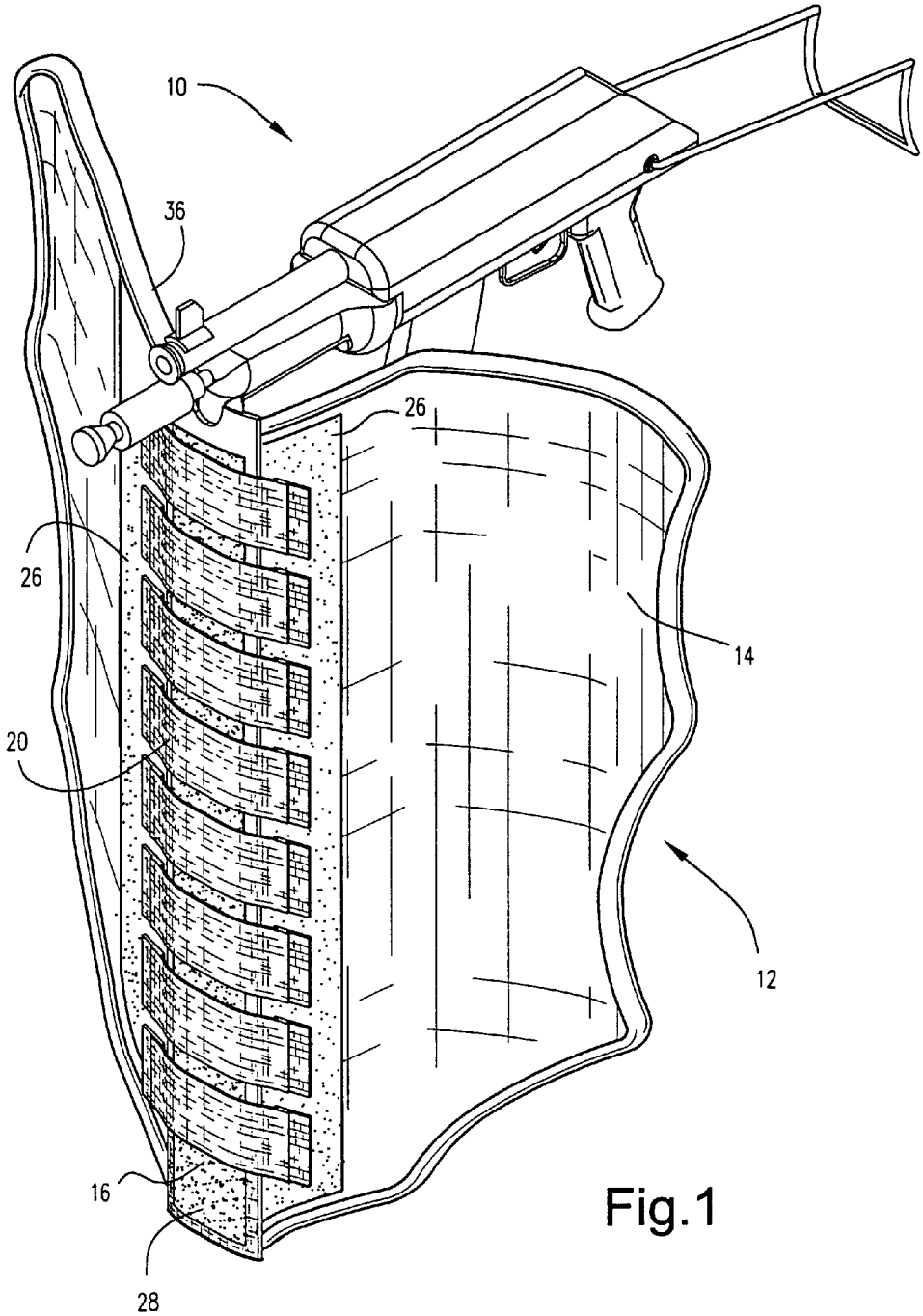
FIG. 1 is a perspective and partial frontal view illustrating a ballistic shield constructed in accordance with a preferred embodiment of the present invention and a long gun in a firing position relative to the shield.
Figure 2:
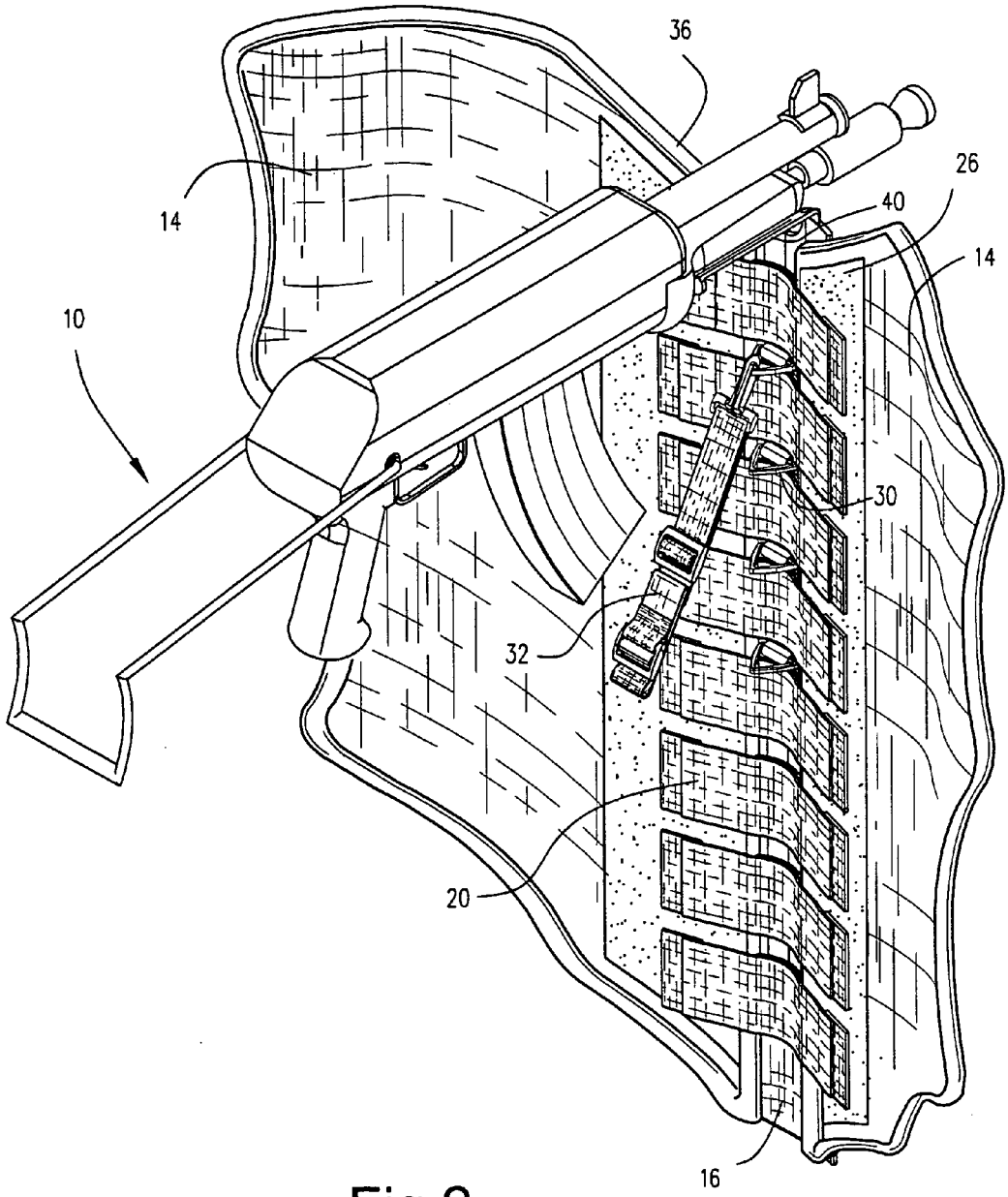
FIG. 2 is a view similar to FIG. 1 but from a reverse side of the shield and long gun.

Referring now to the drawings, particularly to FIGS. 1 and 2, there is illustrated a ballistic shield which, in accordance with a preferred embodiment of the present invention, enables the operator of a long gun to carry, deploy and gain ballistic protection from threats using a torso-covering ballistic shield. As indicated previously, the term "long gun" means any rifle, submachine gun or any other weapons system requiring two-hand operation. It will be appreciated that a wide variety of weapon systems may be used with the ballistic shield hereof and that the long gun generally designated 10 illustrated in the drawings is illustrative of the wide variety of long guns capable of use with the ballistic shield hereof. For example, the Heckler and Koch MP5 9 mm submachine gun is a preferred long gun for use by police, military and the like in those situations requiring use of a ballistic shield. Other types of long guns may also be used, for example, the FN HERSTAL P90 submachine gun, long-barrel shotguns and the like. The ballistic shield, generally designated 12, preferably includes a shield body having a pair of wing sections 14 and a central elongated section or rib 16. The wing sections 14 and central section 16 are formed of a ballistic material. For example, pressed polyethylene may be utilized as the ballistic material. The ballistic material of the wing and central sections has an outer covering preferably formed of nylon suitably adhered to the polyethylene material. Also, the margins of the wing and central sections may also be provided with binding to maintain the covering on the shield. The covering may also be formed of a NOMEX material and flame retardant.

Figure 5:
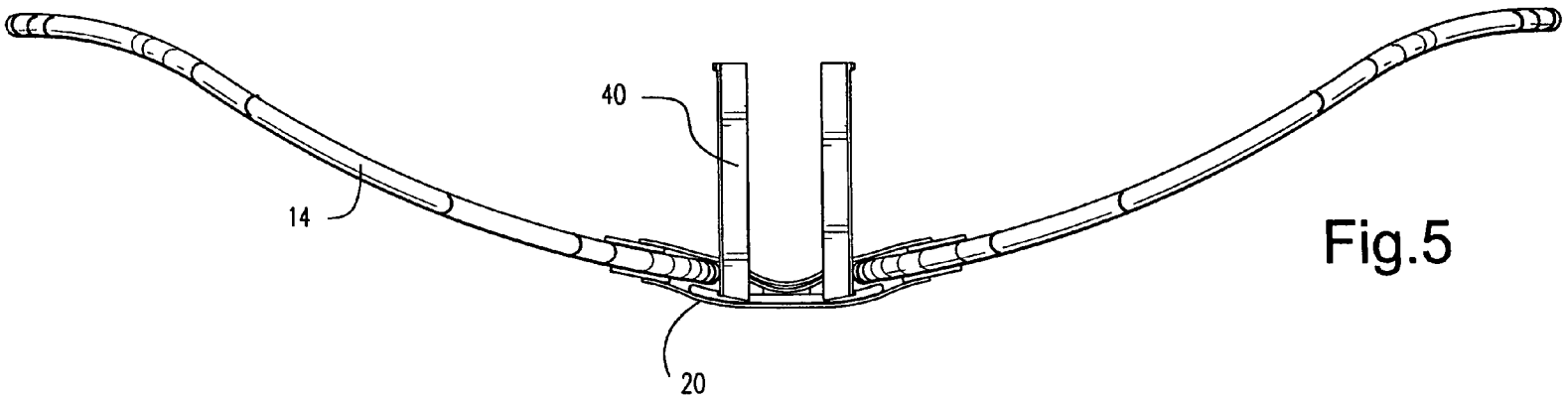
FIGS. 5 and 6 are plan views of the shield illustrating a compound curve of the shield's wing components and two different configurations of the shield using the same shield components.
Figure 6:
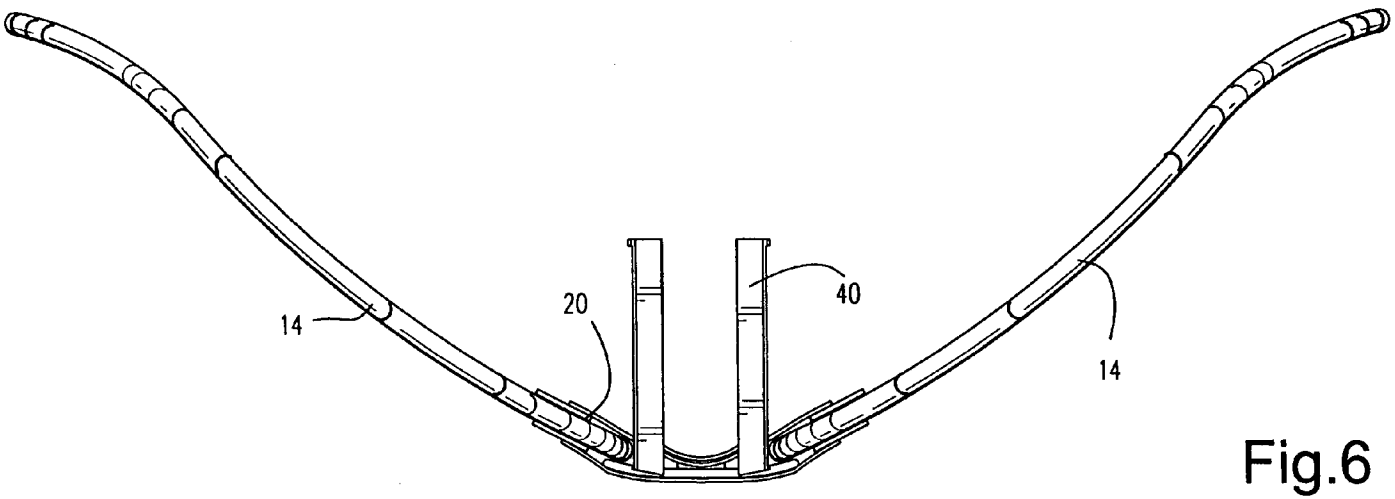

To secure the wing and central sections to one another to form the ballistic shield, as well as to provide a shield adjustable to various widths, a plurality of webs are disposed along both the inside and outside surfaces of the shield spanning the center section 16 and joining the inner margins of the wing sections 14 to the central section 16. The webs 20 are formed of an elastic material and have both at their side edges and central portions one of hook-and-loop fasteners, e.g., Velcro™. The inner margins of the wing sections 14 along both the inside and outside surfaces of the shield have the other of the hook-and-loop fasteners secured thereto. Particularly, and for example, the webs may be provided adjacent their ends and central portions with Velcro™ hooks and the inner margins of the wing sections are provided with Velcro™ loops of the preferred hook and loop fasteners. The margins of the wing are thus provided with strips 26 of loop fasteners for cooperation with the hooks adjacent the ends of the elastic webs 20. Additionally, the inner and outer surfaces of the central section 16 are similarly provided with elongated strips 28 of loop fasteners for cooperation with the hooks along the central portions of the webs 20. By employing a series of webs 20 spaced one from another generally along the vertical length of the shield on both the inside and outside surfaces of the shield, the shield is adjustable in width. That is, the envelope or protected area of lateral frontal protection of the shield may be adjusted by providing a laterally wider or narrower shield. Thus, by adjusting the webs, the lateral extent of the shield may be altered as illustrated in FIGS. 5 and 6. FIG. 5 illustrates a ballistic shield having a wider frontal area than the frontal area of the shield illustrated in FIG. 6. By tensioning and relaxing the elastic webs on selected sides of the shield, the lateral frontal projected area of protection can be adjusted.

Referring to FIGS. 5 and 6, it will be seen that the wing sections 14 are shaped to provide a compound curve in a lateral direction. That is, as viewed from the top of the shield as seen in FIGS. 5 and 6, the wing sections 14 curve in a convex manner from their inner margins and then in a concave manner toward their outer margins. The compound curve of the wings enhances the ability to provide a surface more normal or perpendicular to the threat and hence a surface which is more normal or perpendicular to the anticipated trajectory of a bullet. It is always more favorable for a bullet to hit the shield at 90°, rather than at an angle which permits the bullet to ricochet. A 90° impact absorbs more energy from the bullet and hence enhances the stopping capability of the shield.

Figure 3:
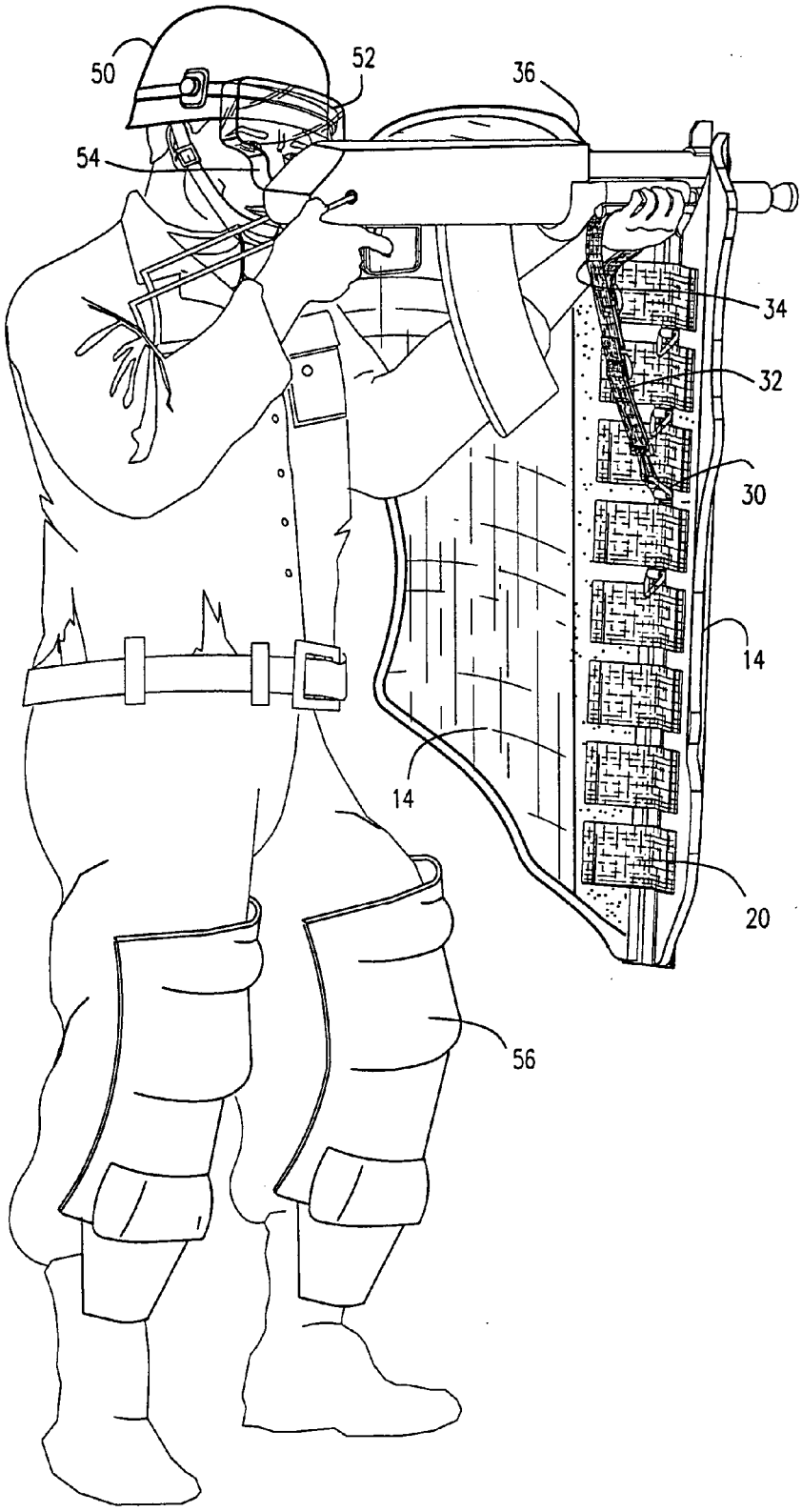
FIG. 3 is a side elevational view of an individual holding the shield using the long gun.
Figure 4:
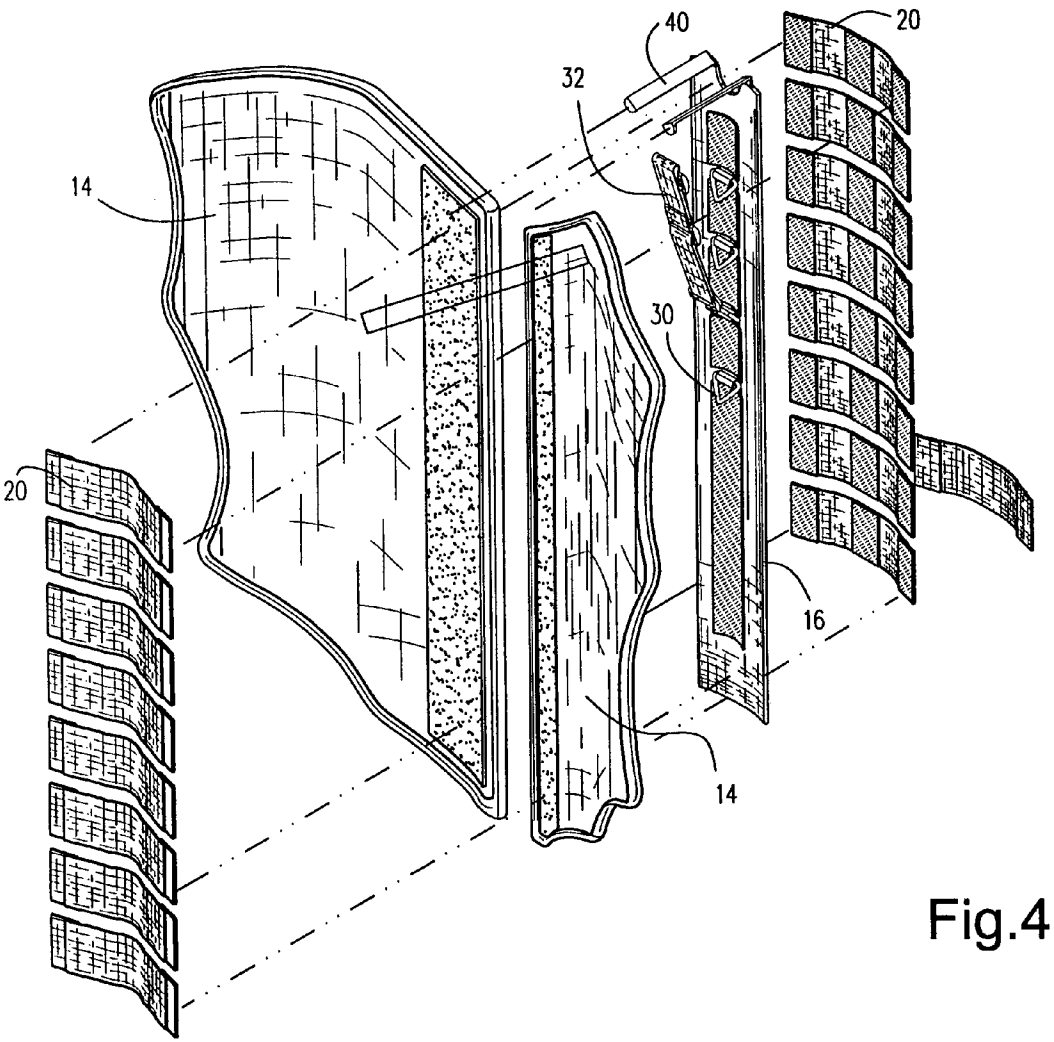
FIG. 4 is an exploded perspective view illustrating various components of the ballistic shield hereof.

Referring back to FIGS. 1 and 2, a number of hooks 30 are provided at vertically-spaced positions along the inside surface of the shield. Particularly, the hooks are suitably secured to the central section 16. One end of a strap 32 is clipped onto a selected hook 30, while the opposite end of the strap forms a loop 34 by which the strap can be grasped by one hand of the operator or disposed about the operator's wrist as illustrated in FIG. 3. The strap 32 is formed of a material sufficient to support the weight of the shield from the individual's hand or wrist. However, the strap does not provide or only partially provides support for the shield during use as explained below. It will be appreciated that the connection between the strap and the shield is adjustable depending upon which hook 30 is used but, in any case, a hook 30 is selected which is above the center of gravity of the shield.

From a review of drawing FIGS. 1-3, it will be appreciated that the shield has a shallow V-groove 36 along its top margin. Adjacent that groove, there is provided a combined long gun shield support/handle 40. Preferably, the support/handle 40 is secured to the central section 16 and projects inwardly from the inside surface of the shield. In the illustrated form, the support/handle 40 comprises a pair of canted strips or rails, preferably formed of spring steel configured to provide a mount or rest for the forward end of the long gun. For example, the MP5 submachine gun has a barrel which may rest on the canted surfaces of the spring steel strips. The strips are spaced close to one another sufficiently such that one hand of an individual can underlie both strips and still grip the forward end or barrel portion of the long gun resting on the strips as best illustrated in FIG. 3. It will be appreciated that the long gun cannot merely rest on the handle/support, but must be gripped by the operator to provide stability to the forward end of the long gun. Thus, as illustrated, the individual may support the shield 10 by grasping the support/handle 40 while simultaneously gripping the forward end of the long gun as it rests on the support/handle. It is therefore evident that the hand that carries the shield also grasps the long gun.

As illustrated in FIG. 3, the strap 32 is disposed about the individual's wrist and need not be used to support the shield. Rather, the shield is preferably wholly supported by the individual's hand underlying the support/handle 40. It will be appreciated, however, that the shield may be partially supported by the strap 34 from the individual's hand or wrist if the individual so desires.

The support/handle 40 may have other configurations depending upon the type of long gun utilized in conjunction with the shield. The illustrated form of support/handle envisions a horizontal portion of the forward end of the gun for support by the support/handle 40 and individual's hand.

Figure 7:
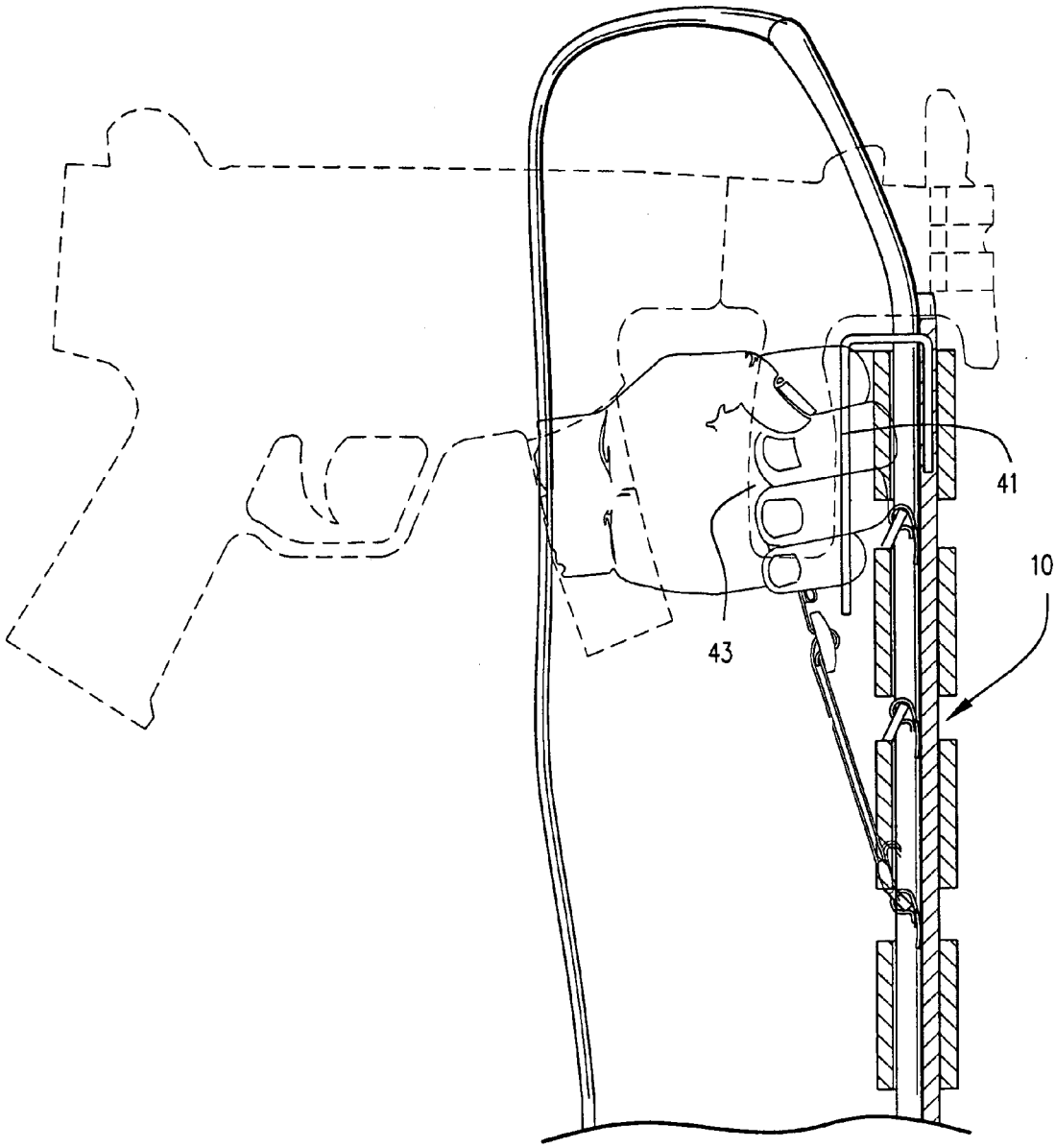
FIG. 7 is a fragmentary view of a portion of the shield and mount for a long gun having a vertical forward grip.

Other types of long guns may have other types of grips, e.g., vertical grips. To provide a long gun support/handle for use with a long gun having a vertical grip, spring steel strips 41 may be bent 90°, as illustrated in FIG. 7, into a substantially vertical position. In that position, the operator's hand may be grasped about both the two vertical strips 41 and the vertical grip 43 of the long gun. Preferably the vertical strips would lie forwardly of the grip, thus enabling the shield to be supported by the same hand that also supports the long gun having the vertical grip. Also, a single strip or other configurations conforming to the forward end of the long gun may be used in lieu of two strips.

In use, the wings and central sections are assembled to provide a ballistic shield of the desired width depending upon the circumstances of its intended use. Obviously, the ballistic shield can be preassembled in standard widths. With the strap 32 coupled to a hook 30 above the center of gravity of the shield, the individual may grasp the free end of the strap through the loop 34 or place the loop 34 about the wrist. Using the same hand, the operator grasps the support/handle 40 and lifts the ballistic shield into a position where the shield provides frontal protection to the individual's torso, for example, as illustrated in FIG. 3. It will also be appreciated that the strap 32 may be hooked to a clip on the individual's vest. This is particularly useful where it is foreseen that the individual may need to climb a ladder or otherwise use both hands in some other capacity whereby the shield can be supported from the individual's body.

With the individual's hand supporting the shield from the support/handle 40, the forward end of the long gun is disposed on the support/handle 40 and grasped or gripped by the same hand of the operator as supports the shield as illustrated in FIG. 3. In that configuration it will be appreciated that the stock of the long gun can be placed against the individual's shoulder and the other hand is free to operate the long gun. The operator may thus advance in a direction of the threat with the ballistic shield affording full frontal protection to the individual's torso. Also, the individual, while supporting the shield with the one hand, is also able to support and manipulate the long gun as desired in the direction of the threat. It will also be appreciated that without the viewport formed of a polycarbonate or lexan material, the present shield, as in conventional ballistic shields formed of polyethylene, is advantageously considerably lighter than such conventional shields.

By employing the strap 32, the long gun may also be readily and easily reloaded. For example, to reload, it is typical to carry a second magazine adjacent the first magazine of the long gun. Thus, by releasing the individual's grasp on the forward end of the long gun and supporting the shield wholly from the strap, the individual's hand can be removed from the support/handle and can change the magazine for the long gun. This reload technique maintains the shield in front of the individual, maintaining frontal ballistic protection during reload. Alternatively, the long gun may be cast aside and the individual's handgun can be removed from its holster and used in a conventional manner, should that need arise.

As illustrated in FIG. 1, the long gun is mounted to extend over the top of the shield. This exposes the individual's head to some extent above the shield. To provide ballistic protection for the individual's head, a standard helmet 50 may be used. The helmet preferably has a visor 52 formed of ballistic material such as a polycarbonate or lexan. While visors are old per se, to accommodate use of the long gun, it is useful to form an undercut 54 along at least one side of the visor such that the visor does not interfere with the long gun when placed against the shoulder of the individual carrying the shield. The undercut is preferably a concave edge formed along at least one side, if not both sides, of the visor. Additionally, shin and leg guards 56 formed of ballistic material are also utilized as is standard in the industry, the leg guards also overlapping the top of the operator's feet. Accordingly, the ballistic helmet with visor, the guards 56, and the shield afford complete frontal ballistic protection.

It will be appreciated that in accordance with the present invention, a single individual may efficiently utilize a long gun while simultaneously carrying the ballistic shield. This affords distinct advantages due to the accuracy of the long gun, its greater stability as compared with a handgun, and also affords increased firepower, i.e., a magazine which holds rounds in substantial excess of the number of rounds in the magazine of a handgun. Moreover, the present ballistic shield is lighter than conventional shields by eliminating the very heavy viewport. Thus, the individual carrying the shield is less prone to fatigue. Note, also, that the present shield may be purposefully infinitely adjustable between a wide or narrow shield by an adjustment of the elastic webs 20 and also has a certain degree of lateral flexibility because of the elastic nature of the straps. That is, the flexibility is not an inherent property of the ballistic material forming the shield but rather is a function of the sectional nature of the shield. Thus, because of the interface between the wing and central section, the shield is flexible in a front-to-back direction and which interface also provides for an adjustment in the width of the shield. Principally, however, the present invention enables an individual to simultaneously carry the shield and deploy a long gun.

Figure 8:
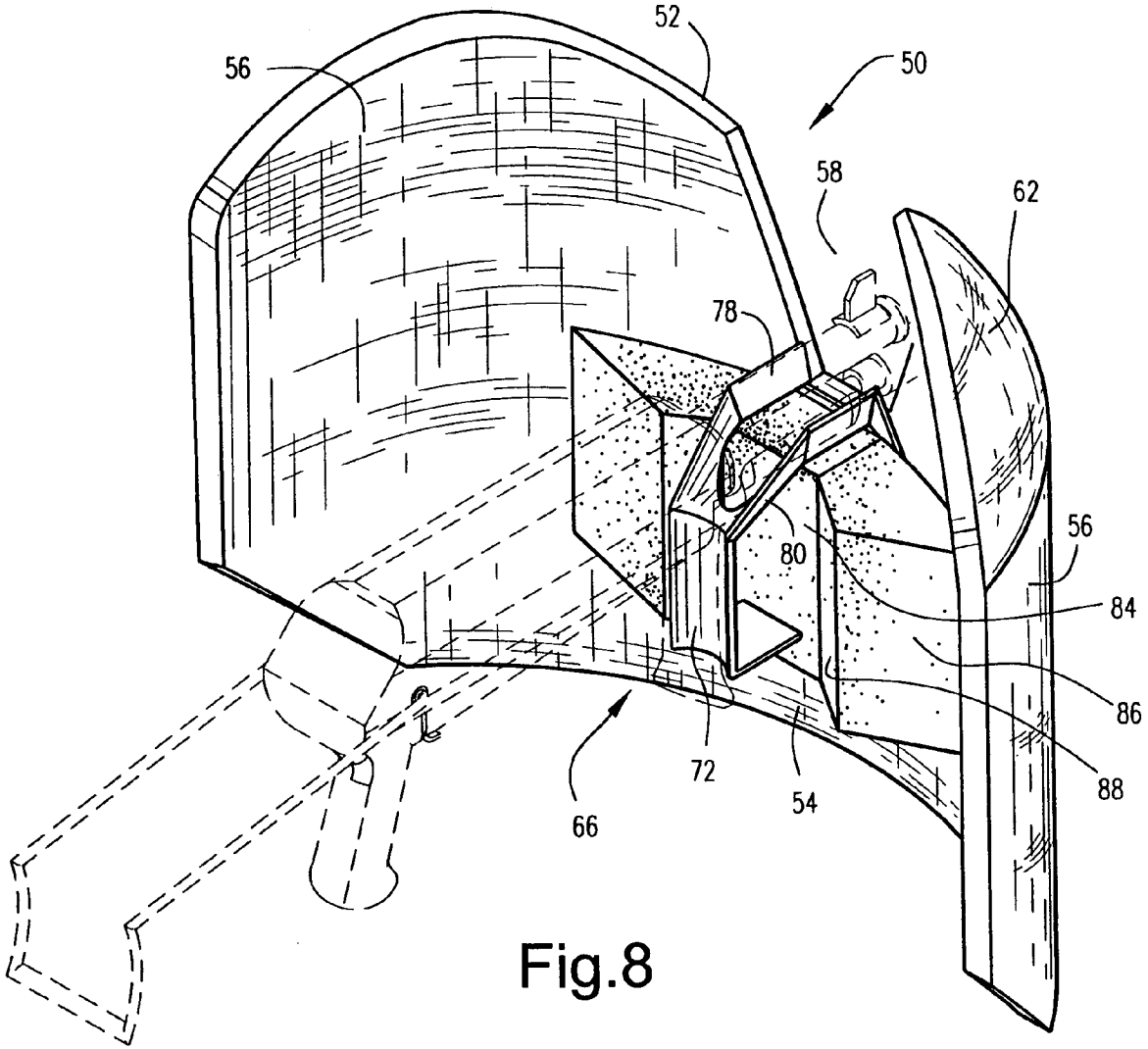
FIG. 8 is a top, rear and side perspective view of a further embodiment of a ballistic shield hereof.
Figure 9:
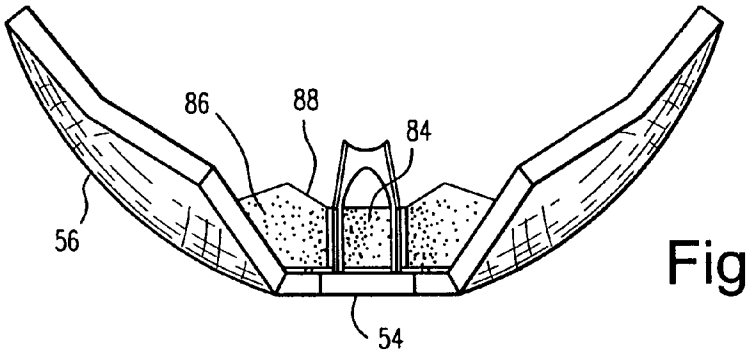
FIG. 9 is a top plan view thereof.
Figure 11:
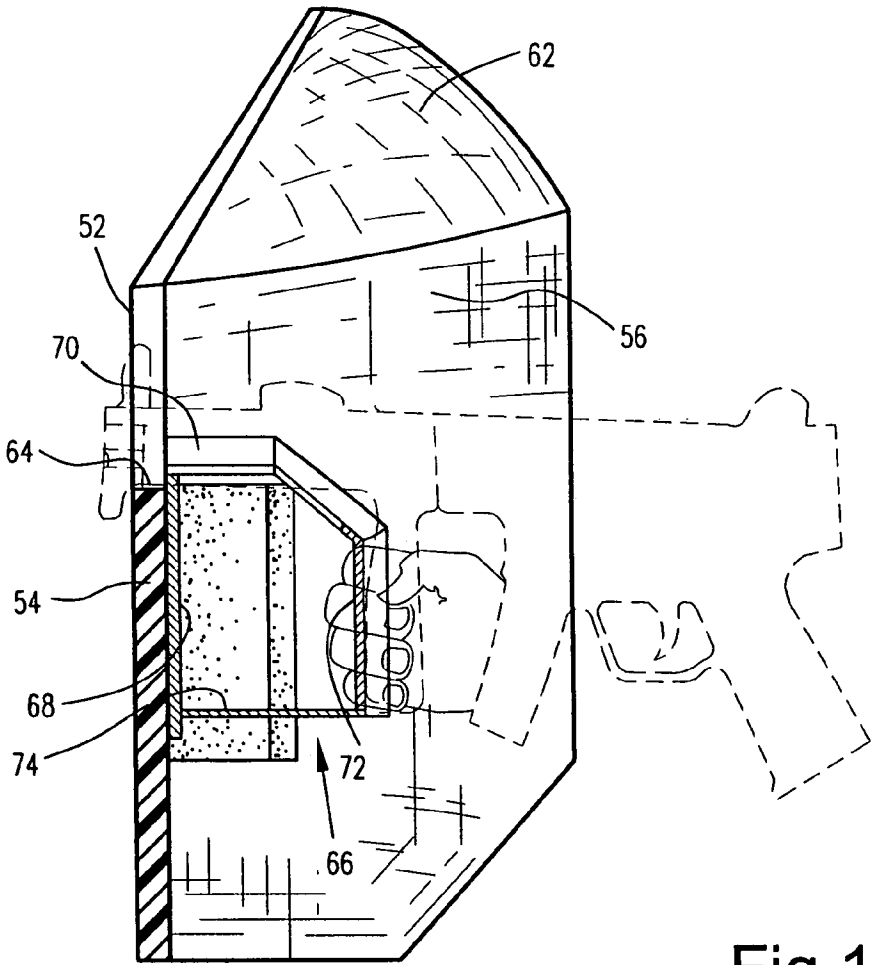
FIG. 11 is a cross-sectional view thereof taken generally about on lines 11-11 in FIG. 10.

Referring now to the embodiment hereof illustrated in FIG. 8, there is illustrated a ballistic shield generally designated 50 including a ballistic shield body 52 formed of like material as in the prior embodiments. In this embodiment, the shield body 52 formed of ballistic material is a one-piece integral construction having a central portion 54 and a pair of side portions 56. As best seen in FIG. 9, the central portion 54 has a relatively flat, vertically extending forward face with the side portions 56 extending laterally and generally rearwardly from the central portion 54. The side portions 56 have a generally convex front surface curving rearwardly, although it will be appreciated that these surfaces may be flat and linear. The side portions 56 extend in a rearward direction to afford an individual on the backside of the shield ballistic protection in part from the opposite sides of the shield. The shield body 52 also includes a V-groove 58 extending generally from approximately mid-height of the front portion 54 of the shield body upwardly and opening through the upper edge of the shield. The V-groove 58 is in part defined by margins 60 of upper side portions 62 of the sides 56. Upper portion 62 taper or are curved inwardly in a direction toward the backside of the shield to provide a greater angle of vision to the individual behind the shield looking through the V-groove 58. The V-groove 58 is truncated, terminating at its lower end in a flat 64 (FIG. 11).

A support generally designated 66 is secured to the backside of the shield body 52 just below the flat 64 at the lower end of V-groove 58. Support 66 includes a front plate 68, a cradle 70 along an upper side thereof, a generally vertically extending handle 72 spaced rearwardly of plate 68 and a support element 74 extending from the lower end of handle 72 and connected at its forward end to the support plate 68. Plate 68 is secured to the back face of the central portion of the shield body by any suitable means.

Figure 10:
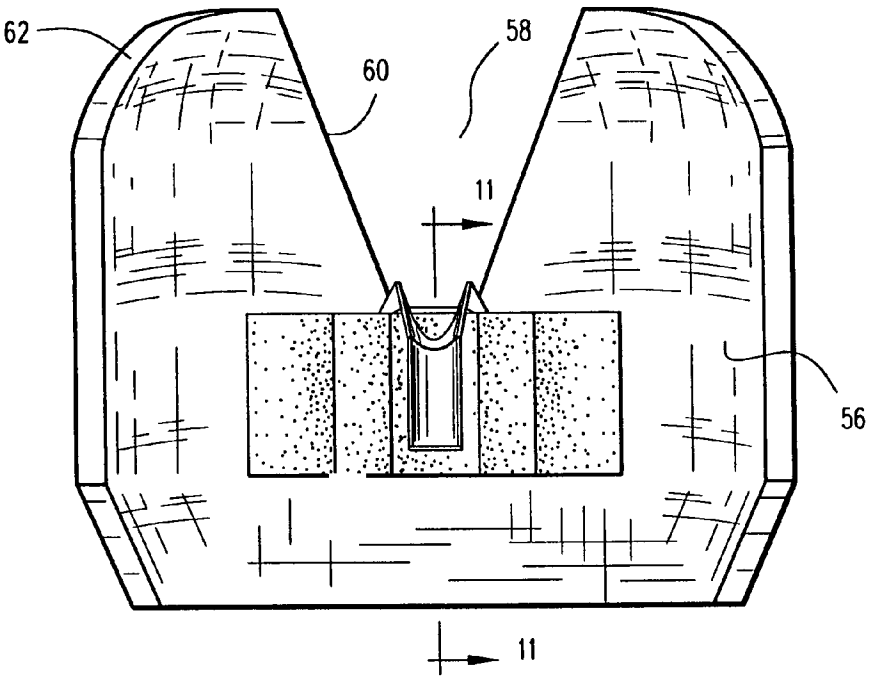
FIG. 10 is a rear elevational view thereof.

As best illustrated in FIGS. 8 and 10, the cradle 70 defines a trough for receiving a portion of the barrel of the long gun. In a preferred embodiment, the trough is formed by a pair of rails 78 which project rearwardly from the central portion 54 of the shield in a generally perpendicular direction relative thereto and which rails 78 have sides inclined toward one another in a downward direction. Thus, the rails 78 receive and support part of the gun barrel, the muzzle of which projects from the opposite side of the shield 50. The rails 78 also include downwardly angled portions 80 which terminate in the handle 72.

The handle 72 is shaped to receive the grip of the long gun. The grip extends generally downwardly from the gun barrel. Thus, the handle 72 is shaped to have a rearward concave, generally vertically extending surface and a forwardly facing convex surface. In this manner, the grip of the long gun may be received in the concave recess of the handle 72 while the barrel rests in the cradle 70. By forming the concave recess along the backside of the handle 72, the individual is able to readily and easily grasp both the handle and the gun grip while the gun grip and the handle lie generally in a vertical direction. Thus, rather than having an open hand with the palm of the hand supporting the shield and the underside of the gun barrel as in the embodiment illustrated in FIG. 3, the individual is able to grasp in a fist-like manner both the grip and the handle. This orientation of the individual's hand has been found to ease the burden of supporting both the shield and the gun from the one hand while simultaneously freeing the other hand to operate the gun.

Referring to FIGS. 8 and 10, resilient material is secured along the backside of the front portion 54 of the shield and parts of the sides of the shield in the vicinity of the support 66. The resilient material may comprise thick foam wrapped in a Nomex material. The resilient material is preferably provided in three blocks. A first block is received and secured to the backside of the front portion of the shield body in overlying relation to plate 68 of support 66. The side blocks 86 are secured to the backsides of the side portions 56 and have angled surfaces 88 which converge toward one another toward the support 66. When the individual grasps the handle and gun grip, the angled surfaces 88 and the backside of the middle foam block 84 wedge or resiliently resist relative movement between the individual's hand and the shield body, affording the individual greater control over the orientation of the shield relative to the individual's body.

In a particular preferred embodiment of the present invention, the shield 50 may have a vertical height of about 19 inches and a width from side edge to side edge of approximately 23 inches. The depth of the shield in a direction generally normal to the front portion of the shield body is approximately 9 inches from the front portion to the edge of the sides. The V-groove may at its base extend laterally 3 inches and be located approximately midway of the height of the shield. The side edges of the V-groove may diverge from one another at about 70° angles relative to the horizontal.

In this form of the present invention, it will be appreciated that the shield 50 affords ballistic protection to the head and shoulder region of the individual to a larger extent than the shield of the first embodiment hereof. However, there is a balance or trade-off between the weight of the shield, a function of the thickness of the ballistic material necessary to stop a high caliber rifle bullet, and the ability of an individual to carry the shield and effectively simultaneously operate the long gun. As a consequence, the shield 50, while affording head and shoulder ballistic protection, extends downwardly approximately to the rib cage of the individual. While the shield can be extended farther downwardly, the weight of the shield may reach a point where the individual can no longer carry the shield and effectively operate the long gun for the necessary period of time. Typically, however, personal body armor is used to protect regions of the individual's body below the lower extent of the shield 50.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed:

1. Ballistic protection apparatus comprising:

a ballistic shield having a body formed at least in part of ballistic material;

said shield body configured to provide frontal ballistic protection at least in part to the torso of an individual when the shield is located in front of the individual;

said shield body having a support on one side thereof for mounting a long gun and configured to enable an individual to simultaneously grasp the long gun and the support by one hand with a barrel of the long gun projecting from the shield body to an opposite side of the shield from the individual and to simultaneously effectively operate the long gun using both hands;

said shield body including a central portion and a pair of side portions on respective opposite sides of said central portion to maintain ballistic protection both frontally and in part from the sides;

said support including a handle spaced from and extending generally vertically and parallel to said central portion of the shield body; and wherein said handle includes a recessed surface along a side thereof remote from said central portion for receiving a grip of the long gun, thereby enabling the individual to simultaneously grasp the handle and grip of the long gun.

2. Apparatus according to claim 1 wherein said support is secured to a backside of the central portion of the shield.

3. Apparatus according to claim 2 wherein said support includes a cradle defining a trough extending generally perpendicular from the backside of the central shield portion for receiving portions of the barrel of the long gun.

4. Apparatus according to claim 3 wherein said cradle extends to a location remote from said shield body and terminates adjacent an upper end of said handle.

5. Apparatus according to claim 4 wherein said support includes a support element extending from a lower end portion of said handle toward said central shield portion enabling said handle to support the shield from said cradle and said support element.

6. Apparatus according to claim 4 wherein said cradle includes a pair of rails having sides inclined downwardly towards one another to form the trough for cradling the long gun barrel.

7. Apparatus according to claim 1 wherein said shield body includes an opening therethrough above the location of said support, said opening being defined in part by lateral margins of said side portions diverging from one another in a general upward direction.

8. Apparatus according to claim 7 wherein said opening opens through an upper edge of the shield body and is in the general shape of a truncated V.

9. Apparatus according to claim 1 including resilient material on the backside of said central shield portion straddling said support and engageable with the one hand of the individual when the individual grasps the long gun and the support with the one hand.

10. Apparatus according to claim 1 wherein said support is secured to a backside of the central portion of the shield and includes a cradle defining a trough extending generally perpendicular from the backside of the central shield portion for receiving portions of a barrel of the long gun, said cradle extending to a location remote from said shield body and terminating adjacent an upper end of said handle, said support including a support element extending from a lower end portion of said handle toward said central shield portion enabling said handle to support the shield from said cradle and said support element, said shield body including an opening therethrough above the location of said support, said opening being defined in part by lateral margins of said side portions diverging from one another in a general upward direction.

11. Apparatus according to claim 10 including resilient material on the backside of said central shield portion straddling said support and engageable with the one hand of the individual when the individual grasps the long gun and the support with the one hand.

12. Ballistic protection apparatus comprising:

a ballistic shield having a body formed at least in part of ballistic material capable of stopping a bullet;

said shield body configured to provide frontal ballistic protection at least in part to the torso of an individual when the shield is located in front of the individual;

said shield body having a support for mounting a long gun and configured to enable an individual to simultaneously grasp the long gun and the support by one hand with a barrel of the long gun projecting forwardly from the shield body and to simultaneously effectively operate the long gun using both hands;

said shield body including a central portion and a pair of side portions on respective opposite sides of said central portion to maintain ballistic protection both frontally and in part from the sides;

said shield body including an opening therethrough above the location of said support, said opening being defined in part by lateral margins of said side portions diverging from one another in a general upward direction to an upper edge of said shield body; and said support including a handle extending generally vertically and parallel to said central portion of the shield body, enabling the individual to simultaneously grasp the handle and grip of the long gun.

13. Apparatus according to claim 12 wherein said handle includes a recessed surface along a side thereof remote from said central portion for receiving a grip of the long gun.

14. Apparatus according to claim 12 wherein said support includes a cradle defining a trough extending generally perpendicular from the backside of the central shield portion for receiving portions of the barrel of the long gun.

15. Apparatus according to claim 14 wherein said cradle extends to a location remote from said shield body and terminates adjacent an upper end of said handle.

16. Apparatus according to claim 15 wherein said support includes a support element extending from a lower end portion of said handle toward said central shield portion enabling said handle to support the shield from said cradle and said support element.

17. Apparatus according to claim 15 wherein said cradle includes a pair of rails having sides inclined downwardly towards one another to form the trough for cradling the long gun barrel.

18. Ballistic protection apparatus comprising:

a ballistic shield having a body formed at least in part of ballistic material;

said shield body including a central portion and a pair of side portions on respective opposite sides of said central portion to provide ballistic protection both frontally and in part from the sides to the torso of an individual when the shield is located in front of the individual;

said shield body having a support on one side thereof for mounting a long gun and configured to enable an individual to simultaneously grasp the long gun and the support by one hand with a barrel of the long gun projecting from the shield body to an opposite side of the shield from the individual and to simultaneously effectively operate the long gun using both hands;

said support including a handle spaced from said central portion of the shield body; and wherein said support includes a cradle defining a trough extending generally perpendicular from the backside of the central shield portion for receiving portions of the barrel of the long gun.

19. Apparatus according to claim 18 wherein said handle includes a recessed surface along a side thereof remote from said central portion for receiving a grip of the long gun, thereby enabling the individual to simultaneously grasp the handle and grip of the long gun.

20. Apparatus according to claim 19 wherein said shield body includes an opening therethrough above the location of said support, said opening being defined in part by lateral margins of said side portions diverging from one another in a general upward direction.

* * * * *